US011459139B2

(12) United States Patent
Matthews

(10) Patent No.: US 11,459,139 B2
(45) Date of Patent: Oct. 4, 2022

(54) METHOD OF FEEDING WEB AND RECLOSURES TO A FORM FILL SEAL MACHINE

(71) Applicant: ILLINOIS TOOL WORKS INC., Glenview, IL (US)

(72) Inventor: David Matthews, Gilman, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/054,205

(22) PCT Filed: May 28, 2019

(86) PCT No.: PCT/US2019/034143
§ 371 (c)(1),
(2) Date: Nov. 10, 2020

(87) PCT Pub. No.: WO2019/231894
PCT Pub. Date: Dec. 5, 2019

(65) Prior Publication Data

US 2021/0070486 A1 Mar. 11, 2021

Related U.S. Application Data

(60) Provisional application No. 62/677,360, filed on May 29, 2018.

(51) Int. Cl.
*B65B 61/18* (2006.01)
*B65B 9/10* (2006.01)

(52) U.S. Cl.
CPC ..... *B65B 61/188* (2013.01); *B65B 9/10* (2013.01)

(58) Field of Classification Search
CPC ..... B65B 61/188; B65B 9/10
See application file for complete search history.

(56) References Cited

U.S. PATENT DOCUMENTS 6,040,033 A * 3/2000 Johnson ..... B32B 3/02 428/99
6,088,998 A * 7/2000 Malin ..... B65D 33/2533 53/416

(Continued)

FOREIGN PATENT DOCUMENTS

CN 101312889 11/2008
CN 101500900 8/2009

(Continued)

OTHER PUBLICATIONS

International Search Report issued in PCT/US2019/034143 dated Aug. 6, 2019.

*Primary Examiner* — Thomas M Wittenschlaeger
*Assistant Examiner* — Katie L Gerth
(74) *Attorney, Agent, or Firm* — McCarter & English, LLP

(57) ABSTRACT

The method and apparatus relate to reclosures in a transverse direction (TD) application, wherein the reclosures include only one consumer side flange, rather than two. That is, the reclosures are missing a flange on the consumer side. A first aspect of the disclosure fills the inverted pouch or package and orients the reclosure with the consumer flange on the leading edge. A second aspect of the disclosure fills the package in a non-inverted configuration and includes a peel seal between the two product side leading flanges below the profile.

15 Claims, 4 Drawing Sheets

(56) References Cited

U.S. PATENT DOCUMENTS 6,115,892 A * 9/2000 Malin ..... B65D 33/2525 24/399
6,116,314 A * 9/2000 Johnson ..... B65B 9/20 156/367
6,138,329 A * 10/2000 Johnson ..... B65D 33/2541 24/584.1
6,151,868 A * 11/2000 Matthews ..... B65B 9/213 53/133.4
6,174,397 B1 * 1/2001 Johnson ..... B32B 5/04 156/227
6,397,561 B1 * 6/2002 Matthews ..... B65B 9/20 493/213
6,428,642 B1 * 8/2002 Matthews ..... B65B 9/20 156/218
6,461,044 B1 * 10/2002 Anderson ..... B65D 33/20 383/204
6,659,643 B2 * 12/2003 Plourde ..... B65D 33/2525 383/203
7,490,451 B2 * 2/2009 Matthews ..... B65B 9/20 493/213
7,635,222 B2 * 12/2009 Plourde ..... B65B 9/20 383/200
8,353,147 B2 * 1/2013 Sprehe ..... B29C 69/006 53/551
2006/0207221 A1 * 9/2006 Ausnit ..... B65B 61/188 53/412
2009/0078595 A1 * 3/2009 McKinley ..... B29C 44/588 53/436
2011/0235951 A1 * 9/2011 Sprehe ..... B65B 51/303 383/210.1
2012/0195531 A1 * 8/2012 Moehlenbrock ... B65D 75/5855 493/227
2012/0224795 A1 * 9/2012 Moehlenbrock ..... B65B 43/42 383/211
2013/0121624 A1 * 5/2013 Lyzenga ..... B65B 61/184 383/203
2014/0093192 A1 * 4/2014 Dais ..... B65D 33/28 53/481
2016/0122087 A1 * 5/2016 Takigawa ..... B65D 33/2508 383/63
2016/0167860 A1 * 6/2016 Tomsovic ..... B65D 75/5805 53/412

FOREIGN PATENT DOCUMENTS

CN 102046484 5/2011
WO 2019/028216 2/2019

* cited by examiner

METHOD OF FEEDING WEB AND RECLOSURES TO A FORM FILL SEAL MACHINE

This is a National Phase application of PCT/US2019/034143 filed on May 28, 2019 which claims priority under 35 U.S.C. 119(e) of U.S. provisional application Ser. No. 62/677,360, filed on May 29, 2018, the contents of which is hereby incorporated by reference in its entirety and for all purposes.

BACKGROUND OF THE DISCLOSURE

Field of the Disclosure

The present disclosure relates to a form fill seal method wherein the web is fed with reclosures in a transverse direction (TD), wherein the reclosures include only one consumer side flange, rather than two. That is, the reclosures include a first consumer side flange but are free of a second consumer side flange.

Description of the Prior Art

In the art of reclosures, particularly child-resistant reclosures, there are reclosures which have only a single consumer side flange, rather than two consumer flanges, as part of a child-resistant or other design.

Such reclosures are typically designed to run in the machine direction, as the missing flange may make it difficult to maintain a transverse direction reclosure in contact with the web or film during the manufacturing process.

While well-suited to its intended purpose, an example of such a reclosure which is typically applied in the machine direction is disclosed in PCT/US2018/44941, entitled "Child Resistant Reclosable Bags," filed on Aug. 2, 2018.

OBJECTS AND SUMMARY OF THE DISCLOSURE

It is therefore an object of the present disclosure to provide an method for applying a reclosure in the transverse direction in a form fill seal application, when the reclosure has less than two consumer side flanges.

This and other objects are attained by providing a form fill and seal method and apparatus wherein the consumer side of the reclosure is oriented as the leading edge of the transverse direction reclosure and the package is inverted during filling. Alternatively, the form fill seal method and apparatus may fill the package in a conventional non-inverted configuration. The two product side flanges extend from the leading edge of the transverse direction reclosure, but are frangibly attached to each other by a peel seal. The peel seal is typically activated either prior to application or during the step that attaches the reclosure transverse to the film or web.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
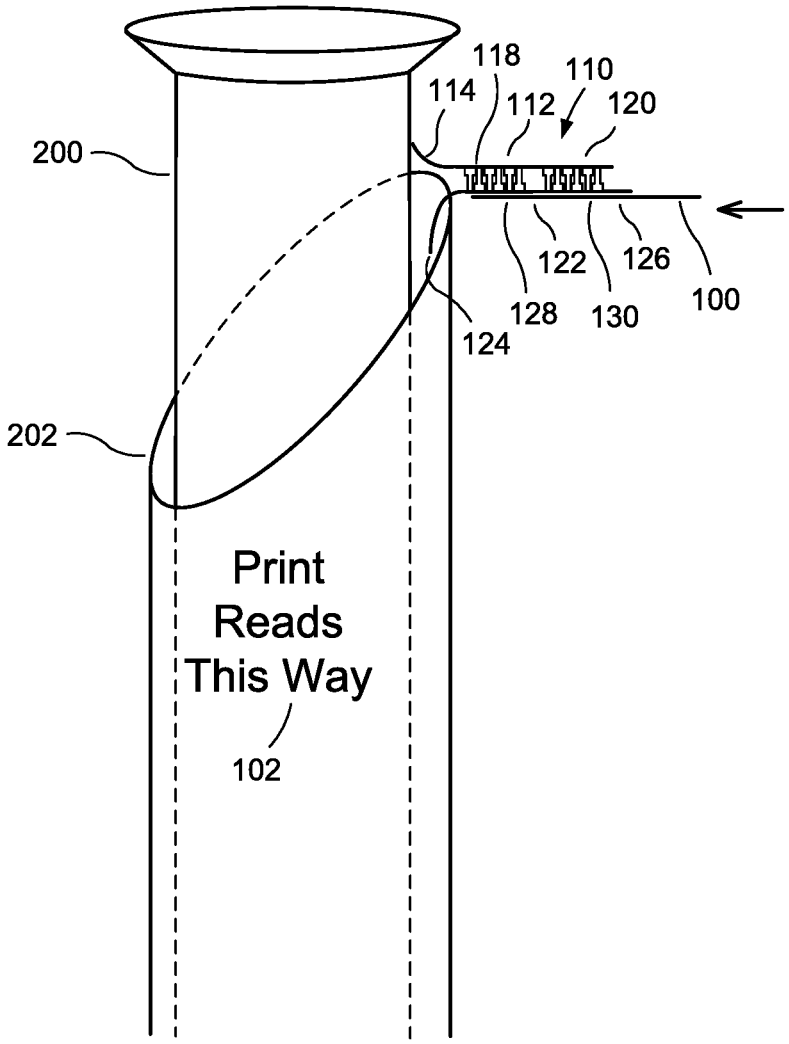
F I G. 1 PRIOR ART
FIG. 1 is a perspective view of the prior art, illustrating how a transverse direction flange of a reclosure with only one consumer side flange can catch on a tube of a vertical form fill seal device.
Figure 4:
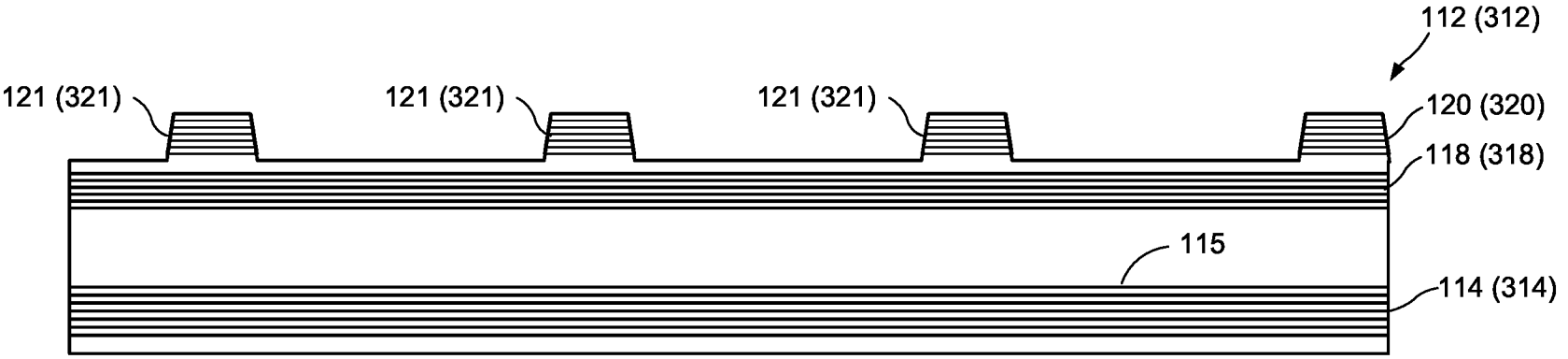
FIG. 4 is a plan view of a first profile a typical reclosure used in the method and device of the present disclosure.
Figure 5:
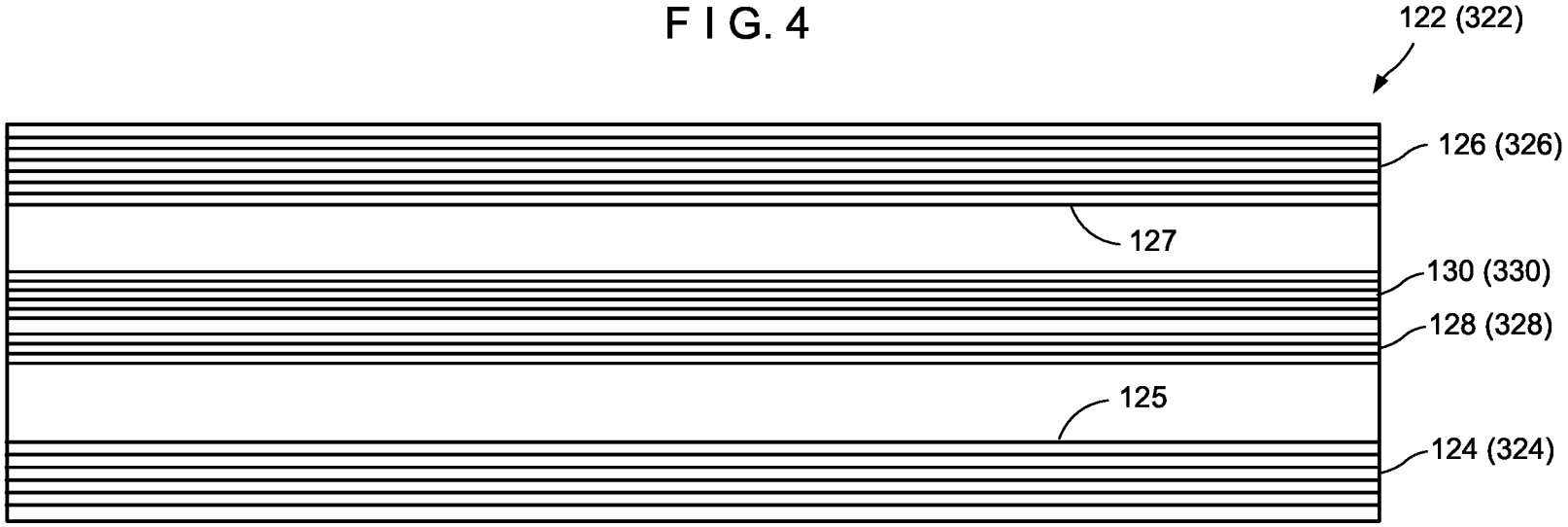
FIG. 5 is a plan view of a second profile of a typical reclosure used in the method and device of the present disclosure.

Referring now to the drawings in detail, one sees the prior art configuration of FIG. 1 wherein a sheet of polymeric web or film 100 is fed wrapped around a fill tube 200 and collar 202 of a vertical form fill and seal machine. The upright printing 102 on web or film 100 indicates that the package is being formed in an upright configuration. The polymeric reclosure, closure or zipper 110 includes a first profile 112 and a second profile 122. The reclosure, closure or zipper 110 becomes an element of the finished bag, pouch or container as produced by the form fill and seal machine. A typical example of the reclosure, closure or zipper 110 is disclosed in PCT/US2018/44941, and is illustrated in FIGS. 4 and 5 herein. The first profile 112, as shown in FIG. 4, is made of polymeric material and includes a first product side (or leading) flange 114 (including several longitudinally extending anti-sealing protrusions 115), and first interlocking elements 118, 120, but does not include a first consumer side (or trailing) flange. As shown in FIG. 4, first interlocking element 120 may be configured as a series of extending tabs 121. The absence of the first consumer side flange, along with the structure of tabs 121, is part of a design to increase the difficulty of opening the package, especially for a child. Similarly, the second profile 122, as shown in FIG. 5, is made of polymeric material and includes a second product side (or leading) flange 124 (including several longitudinally extending anti-sealing protrusions 125), a (second) consumer side (or trailing) flange 126 (including several longitudinally extending anti-sealing protrusions 127), and second interlocking elements 128, 130. In the illustrated closed configuration of reclosure, closure or zipper 110, the first interlocking elements 118, 120 are interlocked with respective second interlocking elements 128, 130 and second product side flange 124 and (second) consumer side flange 126 are sealed to the web or film 100. FIG. 1 illustrates the first and second product side flanges 114, 124 below the interlocking elements with only the second product side flange 124 sealed to the web or film 100 at the point that the web or film 100 enters between the fill tube 200 and the collar 202. The first product side flange 114 is unsealed or unattached to the web or film 100 (that is, no direct sealing or attachment between the first product side flange 114 and web or film 100), and is held in place only by virtue of the interlocking connection between first interlocking elements 118, 120 and second interlocking elements 128, 130. Therefore, in this prior art configuration, the first product side flange 114 has the tendency or possibility to catch on the fill tube 200 during operation.

Figure 2:
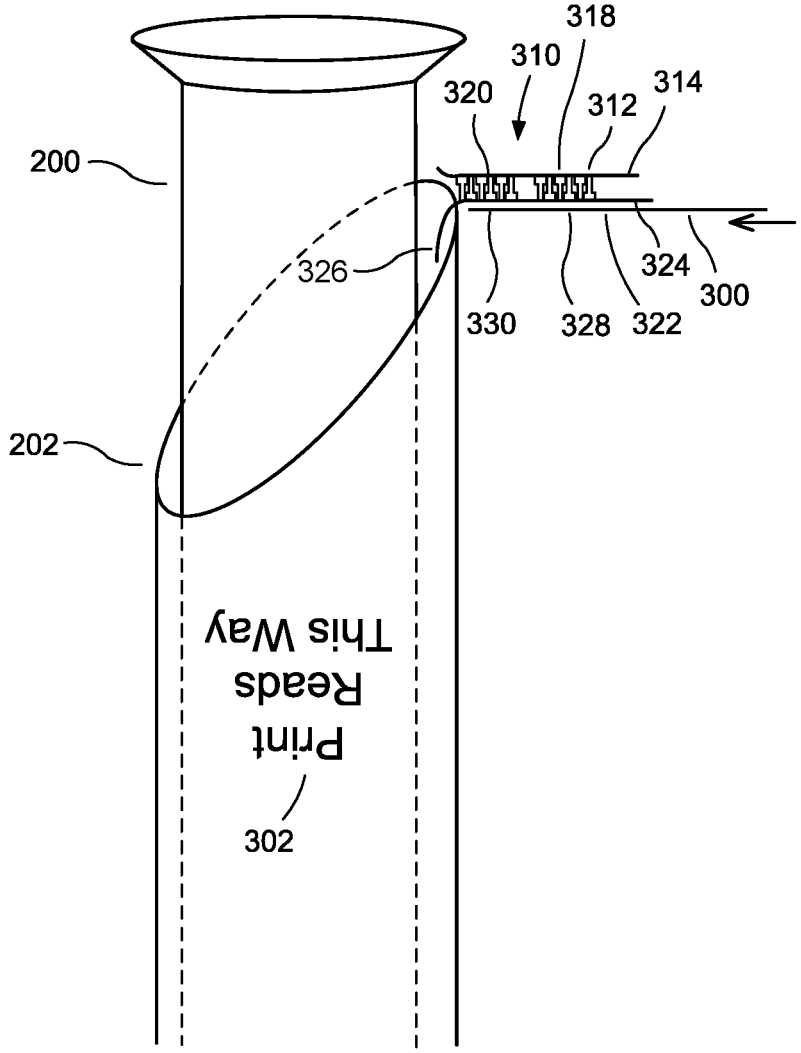
FIG. 2 is a perspective view illustrating an aspect of the present disclosure, wherein the pouch or package is filled from the bottom, with a reversed print and transverse-direction reclosure.

A first embodiment of the present disclosure is illustrated in FIG. 2 wherein the pouch or package is inverted, as indicated by the inverted printing 302 on web or 300 wrapped around the fill tube 200 with concentrically outward collar 202. This inversion causes the package, pouch or container to filled from the bottom. Additionally, the transverse-direction reclosure, closure or zipper 310 is reversed in orientation from that shown in FIG. 1 (i.e., the consumer side is the leading side and the product side is the trailing side in FIG. 2), and includes a first profile 312 and a second profile 322 (see parenthetical numerals in FIGS. 4 and 5). The first and second profiles 312, 322 of the reclosure, closure or zipper 310 may typically be those shown in FIGS. 4 and 5, but are not limited thereto. The reclosure, closure or zipper 310 becomes an element of the finished bag, pouch or container as produced by the form fill and seal machine. The first profile 312 includes a first product (or trailing) side flange 314, and first interlocking elements 318, 320. The first profile 312 does not include a first consumer side (or leading) flange. Similarly, the second profile 322 includes a second product side (or trailing) flange 324, a (second) consumer side (or leading) flange 326, and second interlocking elements 328, 330. In the illustrated closed configuration of reclosure, closure or zipper 310, the first interlocking elements 318, 320 are interlocked with respective second interlocking elements 328, 330. FIG. 2 illustrates the absence of any first consumer side flange on first profile 312. In this configuration, the extending tabs 321 (see FIG. 4) of first interlocking element 320 would be in a leading configuration. FIG. 2 illustrates the (second) consumer side flange 326 below the interlocking elements and sealed to the web or film 100 at the point that the web or film 100 enters between the fill tube 200 and the collar 202. The second consumer side flange 326 being sealed to the web or film 100 in a leading configuration along with the absence of any first leading side flange on first profile 312 substantially eliminates any catching of any flanges on the fill tube 200 when going over the collar 202. The resulting inverted package is filled through the fill tube 200 as is known in the art of form fill seal devices.

Figure 3:
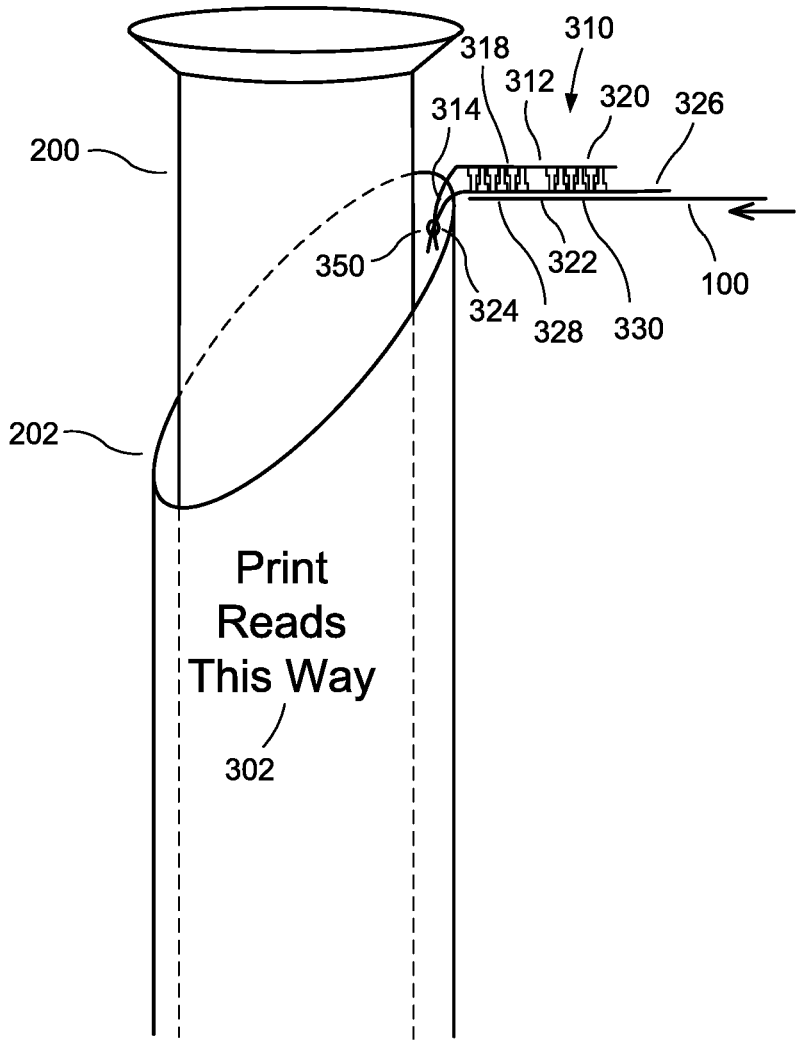
FIG. 3 is a perspective view illustrating a further aspect of the present disclosure, wherein the pouch or package is filled from the top and a peel seal is added below the profile.

A second embodiment of the present disclosure is illustrated in FIG. 3. The printing 302 is illustrated in its ordinary non-inverted configuration, and the orientation of zipper 310 is similar to that of FIG. 1 (product side leading and consumer side trailing). This configuration uses a reclosure, closure or zipper 310 which is similar to that of reclosure, closure or zipper 110 of FIG. 1, in that reclosure, closure or zipper 310 includes a first profile 312 and a second profile 322. The reclosure, closure or zipper 310 becomes an element of the finished bag, pouch or container as produced by the form fill and seal machine. The first profile 312 includes a first product side (or leading) flange 314, and first interlocking elements 318, 320, but does not include a first consumer side (or trailing) flange. Similarly, the second profile 322 includes a second product side (or leading) flange 324, a (second) consumer side (or trailing) flange 326, and second interlocking elements 328, 330. In the illustrated closed configuration of reclosure, closure or zipper 310, the first interlocking elements 318, 320 are interlocked with respective second interlocking elements 328, 330 and second product side flange 324 and (second) consumer side flange 326 are sealed to the web or film 100. Additionally, however, a peel seal 350 is provided between and engaging the first and second product side flanges 314, 324. The peel seal 350 is typically activated either prior to application or during the step that attaches the reclosure, closure or zipper 310 transverse to the film or web 300. The activated peel seal 350 keeps the first and second product side flanges 314, 324 together not allowing the reclosure, closure or zipper 310 to catch when going over the fill tube 200 and collar 202. That is, while the first product side flange 314 is not sealed to the film or web 300, the first product side flange 314 is frangibly attached by peel seal 350 to the second product side flange 324 which, in turn, similar to the illustrated configurations of FIGS. 1 and 2, is sealed to the film or web 300. Additionally, this solution is well-adapted to hermetic applications, with the appropriate choice of jaws.

Thus the several aforementioned objects and advantages are most effectively attained. Although preferred embodiments of the invention have been disclosed and described in detail herein, it should be understood that this invention is in no sense limited thereby.

What is claimed is:

1. A method of feeding web and reclosures to a form fill seal machine, including the steps of:

providing the web;

providing the reclosures transversely across the web, wherein the reclosure includes a first profile with a leading edge which includes a tabbed structure and a second profile including a leading flange extending beyond the leading edge of the first profile, wherein the leading flange is sealed to the web; and feeding the web, including the traverse reclosures, to a filling tube of the form fill seal machine.

2. The method of claim 1 wherein the first profile includes at least one first interlocking element and the second profile includes at least one second interlocking element, wherein the at least one first interlocking element is interlocked with the at least one second interlocking element during the step of feeding the web.

3. The method of claim 2 wherein the first profile includes a first trailing flange and the second profile includes a second trailing flange.

4. The method of claim 3 wherein the leading flange is a consumer side flange and the first and second trailing flanges are respective first and second product side flanges.

5. The method of claim 4 further including the step of wrapping the web around the filling tube to form a package from the web and the reclosure.

6. The method of claim 5 further including the step of filling the packages through the fill tube.

7. The method of claim 6 wherein the packages are inverted.

8. The method of claim 7 wherein the at least one first interlocking element of the first profile includes a plurality of extending tabs.

9. A method of feeding web and reclosures to a form fill seal machine, including the steps of:

providing the web;

providing the reclosures transversely across the web, wherein the reclosures include a first profile with a first leading flange and a second profile with a second leading flange, wherein the first profile has a trailing edge with a tabbed structure and the second profile includes a trailing flange trailing behind the trailing edge of the first profile and wherein the first and second leading flanges are frangibly joined to each other;

sealing the second profile to the web; and feeding the web, including the traverse reclosures, to a filling tube of the form fill seal machine.

10. The method of claim 9 wherein the first and second leading flanges are frangibly attached to each other by a peel seal.

11. The method of claim 10 wherein the first profile includes at least one first interlocking element and the second profile includes at least one second interlocking element, wherein the at least one first interlocking element is interlocked with the at least one second interlocking element during the step of feeding the web.

12. The method of claim 11, wherein the trailing flange is sealed to the web.

13. The method of claim 12 wherein the trailing flange is a consumer side flange and the first and second leading flanges are respective first and second product side flanges.

14. The method of claim 13 further including the step of wrapping the web around the filling tube to form a package from the web and the reclosure.

15. The method of claim 14 further including the step of filling packages through the fill tube.

* * * * *